US006910869B2

(12) United States Patent
Ng et al.

(10) Patent No.: US 6,910,869 B2
(45) Date of Patent: Jun. 28, 2005

(54) VALVELESS MICROPUMP

(75) Inventors: Teng Yong Ng, Singapore (SG); Diao Xu, Singapore (SG); Khin Yong Lam, Singapore (SG)

(73) Assignee: Institute of High Performance Computing, Singapore (SG)

( * ) Notice: Subject to any disclaimer, the term of this patent is extended or adjusted under 35 U.S.C. 154(b) by 89 days.

(21) Appl. No.: 10/230,618

(22) Filed: Aug. 29, 2002

(65) Prior Publication Data

US 2003/0185692 A1 Oct. 2, 2003

(30) Foreign Application Priority Data

Mar. 27, 2002 (SG) ..... 200201762-2

(51) Int. Cl.[7] ..... F04B 17/04; F16L 55/02

(52) U.S. Cl. ..... 417/413.2; 417/413.3; 251/127

(58) Field of Search ..... 417/413.2, 413.3; 251/127

(56) References Cited

U.S. PATENT DOCUMENTS

| | | | | |
|---|---|---|---|---|
| 1,329,559 A | | 2/1920 | Tesla | |
| 3,654,946 A | | 4/1972 | Wieme | 137/81.5 |
| 4,216,477 A | * | 8/1980 | Matsuda et al. | 417/413.3 |
| 5,265,636 A | | 11/1993 | Reed | 137/14 |
| 5,466,932 A | | 11/1995 | Young et al. | 250/289 |
| 5,876,187 A | * | 3/1999 | Forster et al. | 417/322 |
| 6,203,291 B1 | * | 3/2001 | Stemme et al. | 417/413.3 |
| 6,227,809 B1 | * | 5/2001 | Forster et al. | 417/53 |

FOREIGN PATENT DOCUMENTS

| | | |
|---|---|---|
| WO | WO 94/19609 | 9/1994 |

* cited by examiner

*Primary Examiner*—Charles G Freay
(74) *Attorney, Agent, or Firm*—Hogan & Hartson, LLP

(57) ABSTRACT

A valveless micropump includes a hollow pump chamber having a driving element coupled thereto, an inlet channel coupled to the hollow pump chamber, and an outlet channel coupled to the hollow pump chamber. The inlet channel, the hollow pump chamber, and the outlet channel define a fluid flow path through the inlet channel, the hollow pump chamber, and the outlet channel. At least one direction-sensitive element disposed in the flow path within one of the inlet and outlet channels and comprising a direction-sensitive element, is installed at an angle which produces a drag ratio greater than unity on fluid in the flow path. The driving element may comprise an electrostatic/piezoelectric member. Various embodiments of the valveless pump include one or more of the airfoil elements mounted in one, the other or both of the inlet and outlet channels, including embodiments in which one or more cascades of the airfoil elements are mounted in the inlet channel and the outlet channel.

20 Claims, 9 Drawing Sheets

VALVELESS MICROPUMP

BACKGROUND OF THE INVENTION

The invention relates generally to apparatus and methods for controlling the flow of fluids. More particularly, the invention provides a valveless pump of simple construction, and which may be made quite small using micromachining techniques. A pump according to the invention may use internal elements such as airfoil-shaped structures as direction-sensitive elements for producing different drag forces as fluid flows through the micropump in different directions.

Conventional pump designs typically use valves as flow directing elements. These valves allow fluid to flow from the low pressure end to the high pressure end of the pump, and to prohibit flow of the fluid back from the high pressure end to the low pressure end. Several types of valves are used in practice. Passive valves may employ an object such as a movable plate as a direction-checking component. The plate opens due to a pressure difference when fluid is pumped forward, and then closes to prevent fluid flowing backward when the pressure is reversed. Such passive valves are popular in many engineering applications.

Certain drawbacks limit the application of such valves in micropump designs. To begin with, it is not easy to micromachine the micro-dimensioned moving parts that such valves require. Secondly, the actions of the moving parts, such as the opening and closing of the plate, may damage cells within bio-fluids or other fragile substances. Thirdly, when the working fluid includes particles, the valve may become blocked by a collection of those particles between the moving elements. Finally, the continuous opening and closing action may lead to fatigue in the valves and failure of the micropump.

Active valves have similar drawbacks, but provide greater freedom for control of the fluid delivery, and less backflow. Active valves are even more difficult to fabricate, though, because of the greater complexity of the moving parts and other related structures.

Valveless micropumps or fixed valve micropumps have been devised and are finding increasing application, especially in bio-engineering applications. There are several advantages in valveless micropumps. Firstly, the valveless micropumps are much easier to fabricate using standard micro-machining techniques. Secondly, valveless micropumps are more reliable because there are no moving elements in the inlet and outlet channels. Thirdly, the valveless micropumps, unlike other pump designs, do not have any moving components in the inlet and outlet channels, and therefore will not cause much damage to bio-molecules. Also malfunctions due to blockages are minimized.

It is known in the art to provide a fixed valve conduit in which the design of the conduit is flow-direction sensitive. A lower drag force is produced when fluid flows in a forward direction than when the fluid is flowing in a backward direction. Such designs may be based on the concept of non-unit drag ratio of the backward flow to the forward flow. The efficiency of the one-directional flow conduit can be measured by such ratio. The larger the ratio, the more effective the valving action of the conduit.

It is also known in the art to provide a micropump having fixed valves fabricated using micromachining techniques. Again, the design thereof can be based on the concept of differentiated drag between the forward and backward flows.

Other work has been directed toward the aerodynamic characteristics of airfoils. Lift and drag forces have been measured for different angles of attack of airfoils from zero to 180 degrees. Airfoils have been shown to have different drag values for fluid flows arriving from different directions. The following table lists measured drag coefficients Cd for various angles of attack a:

TABLE 1

| a | 0 | 5 | 10 | 15 | . . . | 165 | 170 | 175 | 180 |
|---|---|---|---|---|---|---|---|---|---|
| Cd | 0.0103 | 0.0140 | 0.0188 | 0.1900 | . . . | 0.2300 | 0.1400 | 0.0550 | 0.0250 |

Cd is defined by:

$$Cd = \frac{\text{Drag}}{1/2\rho g V^2} \qquad \text{Eq. 1}$$

where Drag is the drag force caused by the flow; ρ is the density of the working fluid; g is the gravitational force and V is the flow velocity.

From Table 1, the drag ratios between the forward and backward flow may be obtained (from opposite directions). This ratio, η, is also known as the drag efficiency and is defined by:

$$\eta = \frac{Cd_{180-a}}{Cd_a} \qquad \text{Eq. 2}$$

Table 2 gives the η ratios for a ranging from 0 degrees to 15 degrees, based on Table 1 and Equation 2.

TABLE 2

| Drag efficiency at Reynolds number 160,000 | | | | | |
|---|---|---|---|---|---|
| a | 0 | 5 | 10 | 15 | . . . |
| n | 2.4272 | 3.9286 | 7.4468 | 1.6842 | . . . |

From Table 2, it can be clearly observed that airfoils can generate very high drag efficiency. This becomes obvious when it is noted that the airfoil exhibits its streamline-body characteristic property when the flow direction is from its leading edge to its trailing edge. In the reverse flow direction when the flow is from the trailing edge to the leading edge, the airflow no longer presents itself as a "streamline body" and shows non-streamline characteristics.

It would be desirable if an improved micropump could be devised to take advantage of advances in knowledge regarding the behavior of airfoils in moving fluids. Such a micropump should be reliable, efficient, of simple construction, and feasible to fabricate using known micromachining techniques. These and other advantages are provided by the novel apparatus and methods described herein.

SUMMARY OF THE INVENTION

The present invention provides a valveless micropump which includes a hollow pump chamber having a driving element coupled thereto, an inlet channel coupled to the hollow pump chamber and an opposite outlet channel coupled to the hollow pump chamber. The inlet channel, the hollow chamber and the outlet channel define a fluid flow path through the inlet channel, the hollow pump chamber, and the outlet channel. At least one direction-sensitive element is disposed in the flow path within one of the inlet and outlet channels. The direction-sensitive element may comprise an airfoil installed in the fluid flow path at an angle which produces a drag ratio greater than unity on the fluid in the flow path. The driving element may comprise an electrostatic/piezoelectric member. The airfoil element preferably has an angle of attack of 0 degrees–10 degrees. Satisfactory results may be produced at an angle of 0 degrees or 10 degrees or at some value therebetween.

In accordance with various embodiments of the invention, a second airfoil element may be mounted in one of the inlet and outlet channels together with the first airfoil element. The first and second airfoil elements may both be mounted in the inlet channel, or they may both be mounted in the outlet channel. As a further alternative, the first airfoil element may be mounted in the inlet channel and the second airfoil element may be mounted in the outlet channel. Still further, a first plurality of airfoil elements may be mounted in the inlet channel and a second plurality of airfoil elements may be mounted in the outlet channel. Each of the first and second pluralities of airfoil elements may comprise a single cascade of such elements or each may comprise a plurality of cascades of such elements.

In accordance with the invention, the airfoil elements are arranged so that they produce different drag forces on the fluid as it flows in different directions. The airfoil elements function as flow rectifying elements, allowing the fluid to flow more easily in one direction as compared with the opposite direction. The drag ratio of the backward flow against the forward flow of the micropump is therefore larger than unity. A principal feature in accordance with the invention is the ability of the valveless micropumps in accordance therewith to produce lower forward flow drag and higher backward flow drag, so that a high flow rate is produced when compared with other designs. The micropump structure is an integrated structure and can be fabricated using standard micromachining techniques.

DESCRIPTION OF THE PREFERRED EMBODIMENTS

Figure 1A:
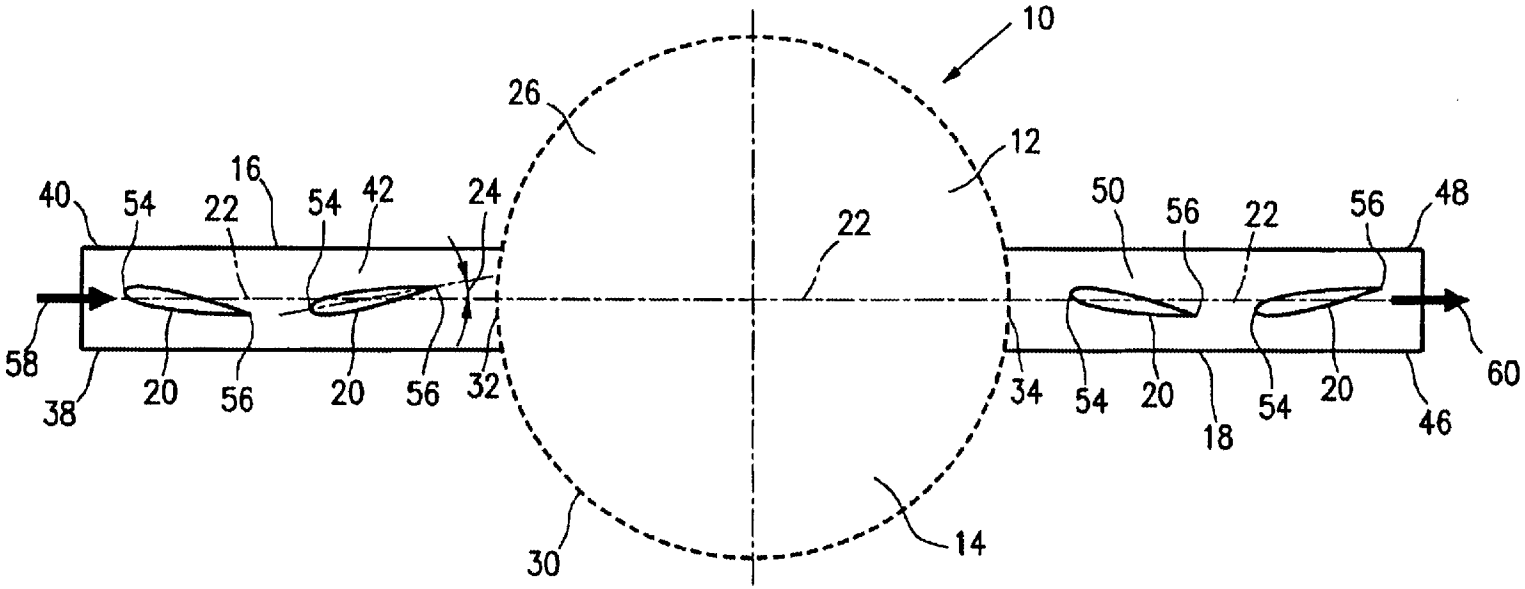
FIG. 1A is a top view of a first embodiment of a micropump in accordance with the invention, which has a plurality of airfoil elements.
Figure 1B:
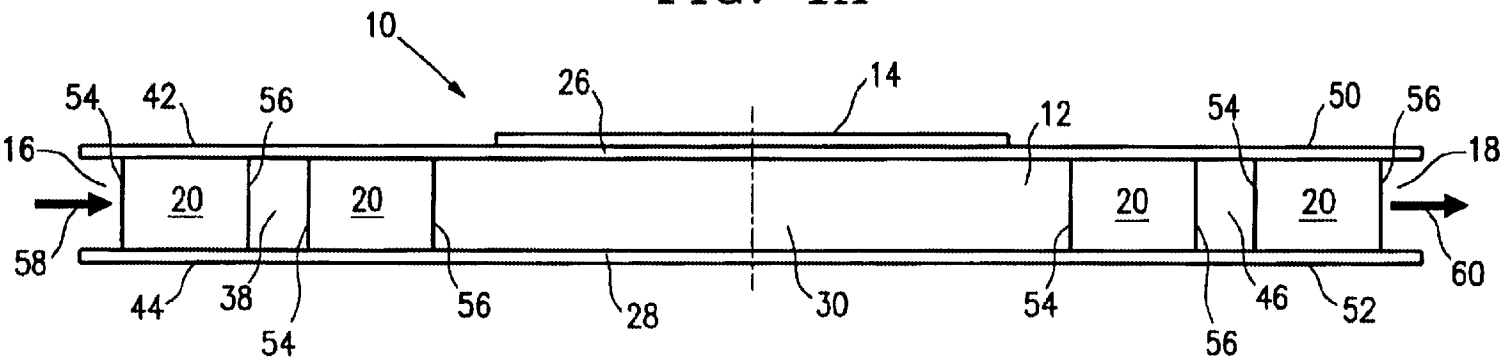
FIG. 1B is a front view of the micropump of FIG. 1A.

FIGS. 1A and 1B are top and front views, respectively, of a first embodiment of a valveless micropump 10. The micropump 10 includes a micropump chamber 12 with an electrostatic or piezoelectric membrane 14 mounted thereon. Opposite inlet and outlet channels 16 and 18 are coupled to the micropump chamber 12.

As shown in FIG. 1A, the valveless micropump 10 has two airfoil-shaped elements 20 mounted in each of the inlet and outlet channels 16 and 18. The airfoil-shaped elements 20 present a predetermined angle of attack relative to a central axis or axis of elongation 22 extending through the micropump 10. One such angle 24 is shown in FIG. 1A. Though these elements are described herein mainly as "airfoils," it should be appreciated that the pumped fluid may be either a gas or a liquid, and is by no means limited to air.

The micropump chamber 12 is of generally cylindrical configuration so as to have a circular top 26, an opposite circular bottom 28, and a wall 30 of circular configuration extending between the top 26 and the bottom 28. An electrostatic or piezoelectric membrane 14 serves as the driving member for the micropump 10. The membrane 14 is of generally circular configuration and is mounted on the top 26 of the chamber 12. Opposed inlet and outlet channels 16 and 18 are coupled to the micropump chamber 12 through openings 32 and 34 respectively in the circular wall 30 of the micropump chamber 12. The inlet and outlet channels 16 and 18 and the micropump chamber 12 are arranged so that the central axis or axis of elongation 22 extends through each of the inlet and outlet channels 16 and 18 and through the center of the micropump chamber 12.

The inlet channel 16 has opposed, generally parallel sidewalls 38 and 40 extending between a top 42 and a bottom 44. The top 42 and bottom 44 are generally planar and continuous with the top 26 and bottom 28, respectively, of the micropump chamber 12. Similarly, the outlet channel 18 includes opposed, generally parallel sidewalls 46 and 48 extending between a top 50 and a bottom 52. The top 50 and the bottom, 52 are generally planar and continuous with the top 26 and bottom 28, respectively, of the micropump chamber 12.

As shown in FIG. 1B, the airfoil-shaped elements 20 within the inlet channel 16 extend upwardly from the bottom 44 to the top 42 thereof. Similarly, the airfoil-shaped elements 20 within the outlet channel 18 extend upwardly from the bottom 52 to the top 50 of the outlet channel 18.

In the valveless micropump 10 of FIGS. 1A and 1B, each of the inlet and outlet channels 16 and 18 has two of the airfoil-shaped elements 20 mounted therein. As will become apparent from the discussion to follow, however, other arrangements of airfoil-shaped elements 20 are possible. It is possible, for example, to mount a single one of the elements 20 or a plurality of the elements 20 in one or the other but not both of the inlet and outlet channels 16 and 18.

It is also possible to provide each of the inlet and outlet channels 16 and 18 with a single cascade or a plurality of cascades of airfoil elements 20.

As shown in FIG. 1A, each of the airfoil-shaped elements 20 has a leading edge 54 and a trailing edge 56. Fluid flows through the inlet channel 16, the micropump chamber 12 and the outlet channel 18 in a direction shown by arrows 58 and 60 at the inlet channel 16 and the outlet channel 18 respectively. The airfoil-shaped elements 20 are mounted so that the leading edge 54 of each faces in an upstream direction relative to the flow. As previously noted, each airfoil-shaped element 20 is mounted so as to be at a desired angle of attack relative to the central axis 36. As previously noted, one such angle 24 is shown in FIG. 1A.

Figure 2:
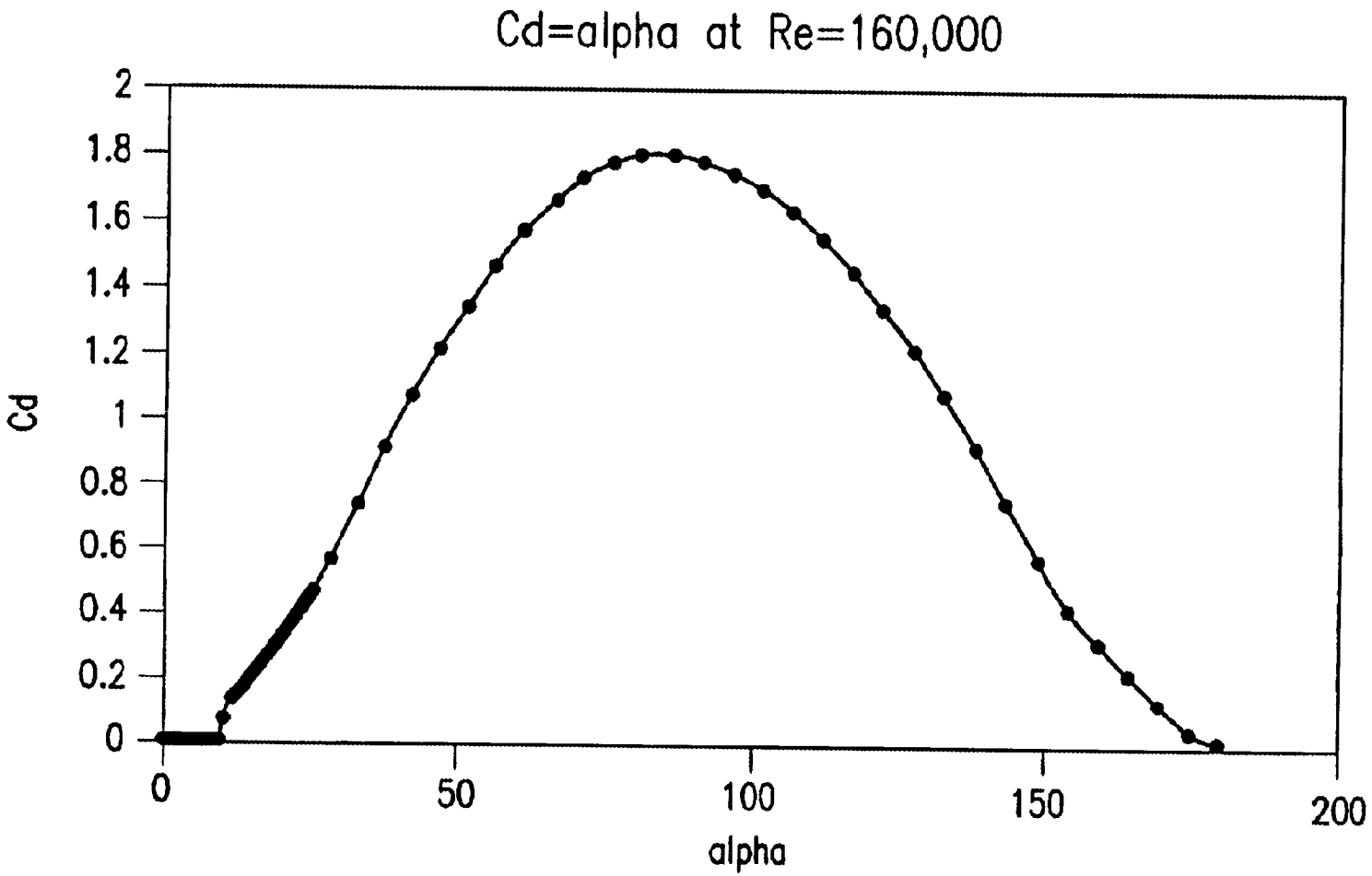
FIG. 2 is a diagrammatic plot of drag coefficient of an airfoil element for various angles of attack.

FIG. 2 is a diagrammatic plot of drag coefficient as a function of angle of attack for an airfoil element of particular configuration. In the particular example shown, when the angle of attack is less than 11 degrees, the drag is very small.

As described above, a drag ratio can be defined as the ratio between the drag generated when the flow is from the leading edge to the trailing edge of the airfoil, and the drag generated when the flow is from the trailing edge to the leading edge. This ratio provides a relative measure of flow resistance through the micropump from the two opposing flow directions and is useful to define or quantify the efficiencies of valveless pumps. If the ratio is larger than unity, the drag generated when the working fluid flows from the leading edge to the trailing edge is lower than that generated when the flow is in the opposite direction. In other words, if the airfoil element is mounted in a channel of a micropump, and an alternating-flow fluid passes through, fluid will flow more easily and thus preferentially in a direction from the leading edge to the trailing edge of the airfoil element. Over time, a net flow of fluid will occur in this direction. If the ratio is less than unity, a net flow from the trailing edge to the leading edge results, and if the ratio is equal to unity, there will be no net flow. The higher the ratio, the higher will be the net flow, and thus the higher the efficiency of the valveless micropump.

Figure 3:
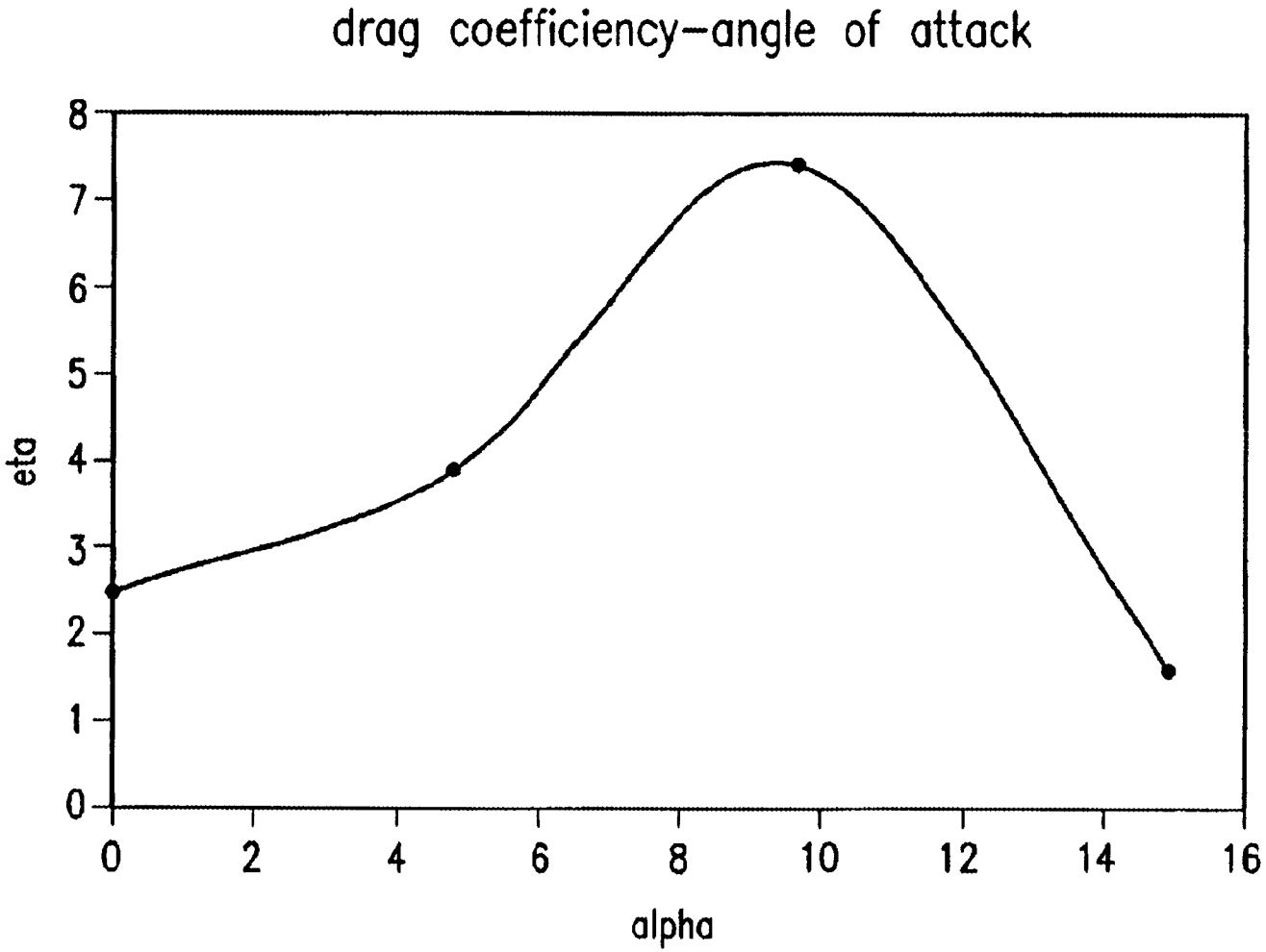
FIG. 3 is a diagrammatic plot showing the relationship between the angle of attack and the drag efficiency.

Equations 1 and 2, above, can be used to calculate drag coefficients and drag ratios for a given airfoil configurations. FIG. 3 is a diagrammatic plot of the relationship between angle of attack and drag efficiency as calculated using equations 1 and 2. The drag ratio increases steadily from 2.4272 at $\alpha$=0.0 to a maximum of 7.4468 at $\alpha$=10.0. This maximum is several times unity, which suggests that airfoil elements of this type can find effective use as direction sensitive flow control elements in valveless pump configurations of the type described in this document.

Figure 4A:
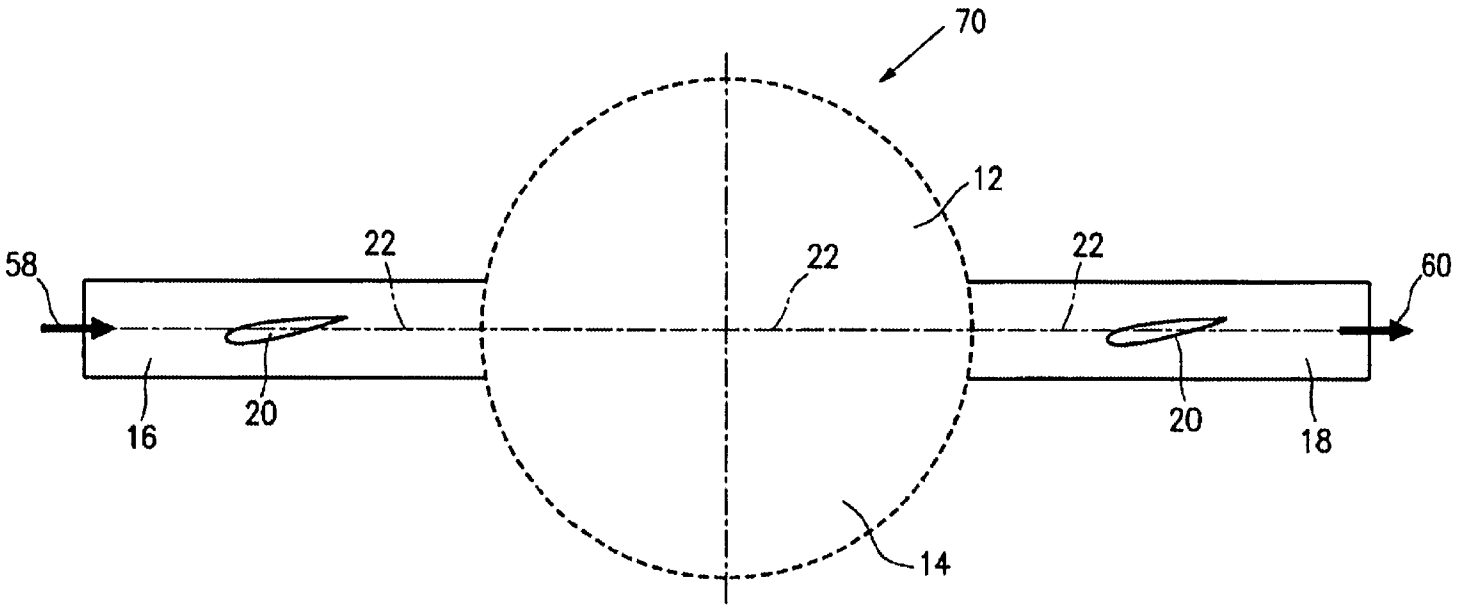
FIG. 4A is the top view of another embodiment of a micropump in accordance with the invention having a single airfoil element at an angle of attack of 10 degrees in each of the inlet and outlet channels.
Figure 4B:
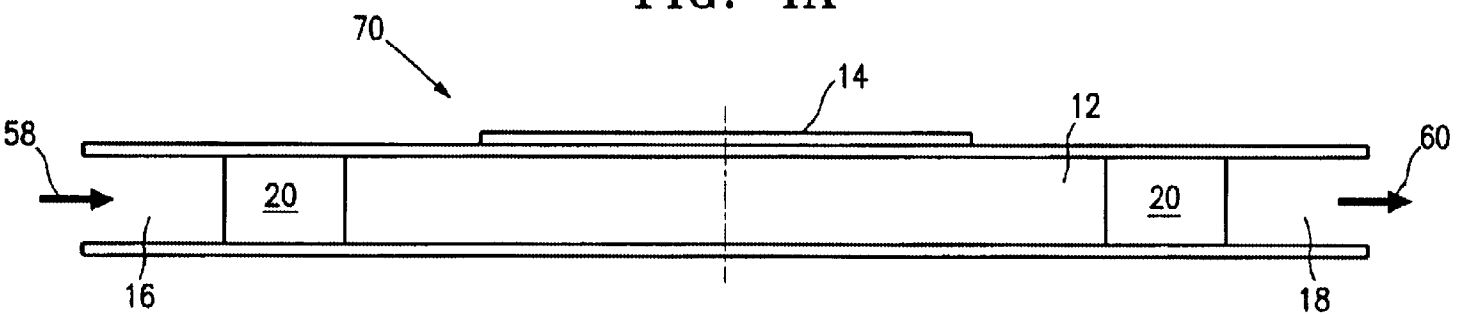
FIG. 4B is a front view of the micropump of FIG. 4A.

As previously noted, there is no special limitation on the number of airfoil-shaped elements 20 that can be mounted in the inlet and outlet channels 16 and 18. FIGS. 4A and 4B are top and front views of a second embodiment of a valveless micropump 70. In this embodiment, a single airfoil-element 20 is mounted in each of the inlet and outlet channels 16 and 18. Like reference numerals are used to identify parts of the valveless micropump 70 similar to those of the valveless micropump 10 of FIGS. 1A and 1B. Again, each of the airfoil-shaped elements 20 is mounted at a desired angle of attack relative to the central axis 22.

In designing micropumps according to the invention, careful consideration should be given to the number of airfoil elements used, the flow-rate, and the power consumption. Additional airfoil elements increase the drag ratio and thus the directional efficiency and flow-rate, but this also results in higher power consumption.

Figure 5A:
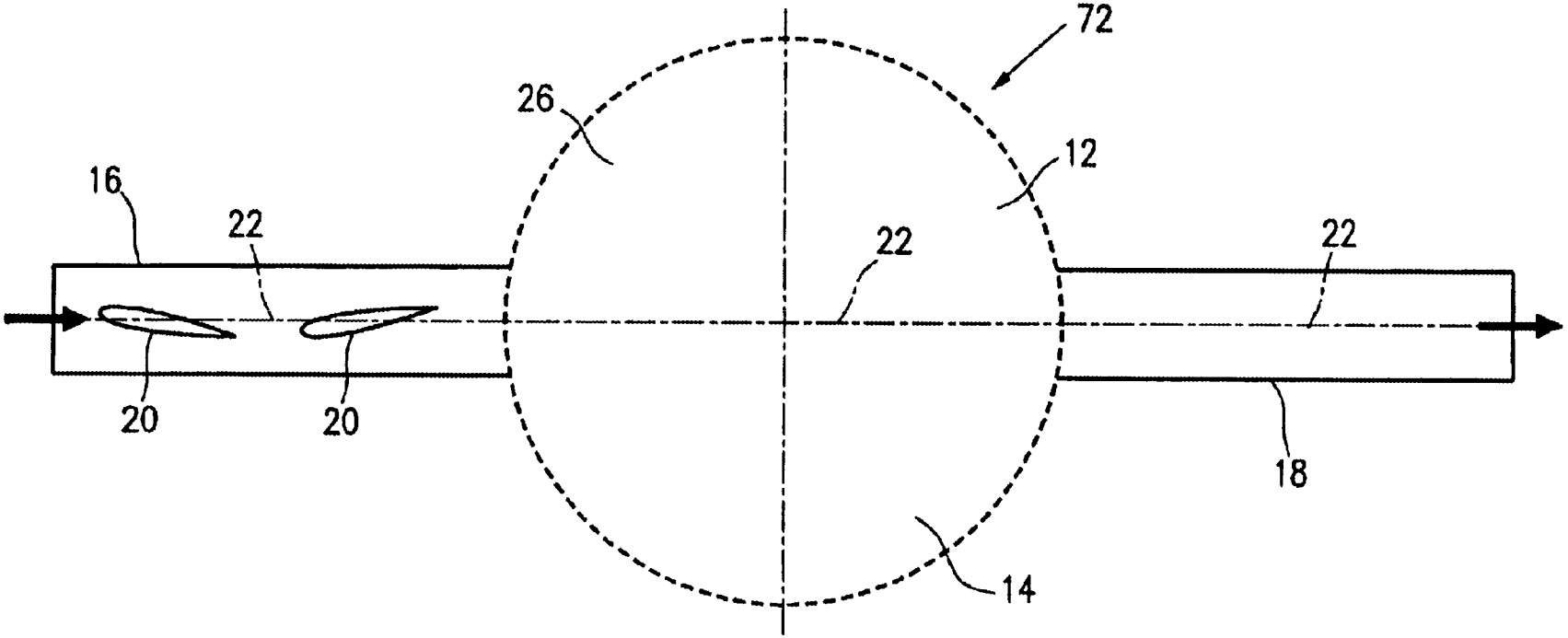
FIG. 5A is a top view of a still further embodiment of a micropump in accordance with the invention, having multiple airfoil elements mounted only in the inlet channel thereof.
Figure 5B:
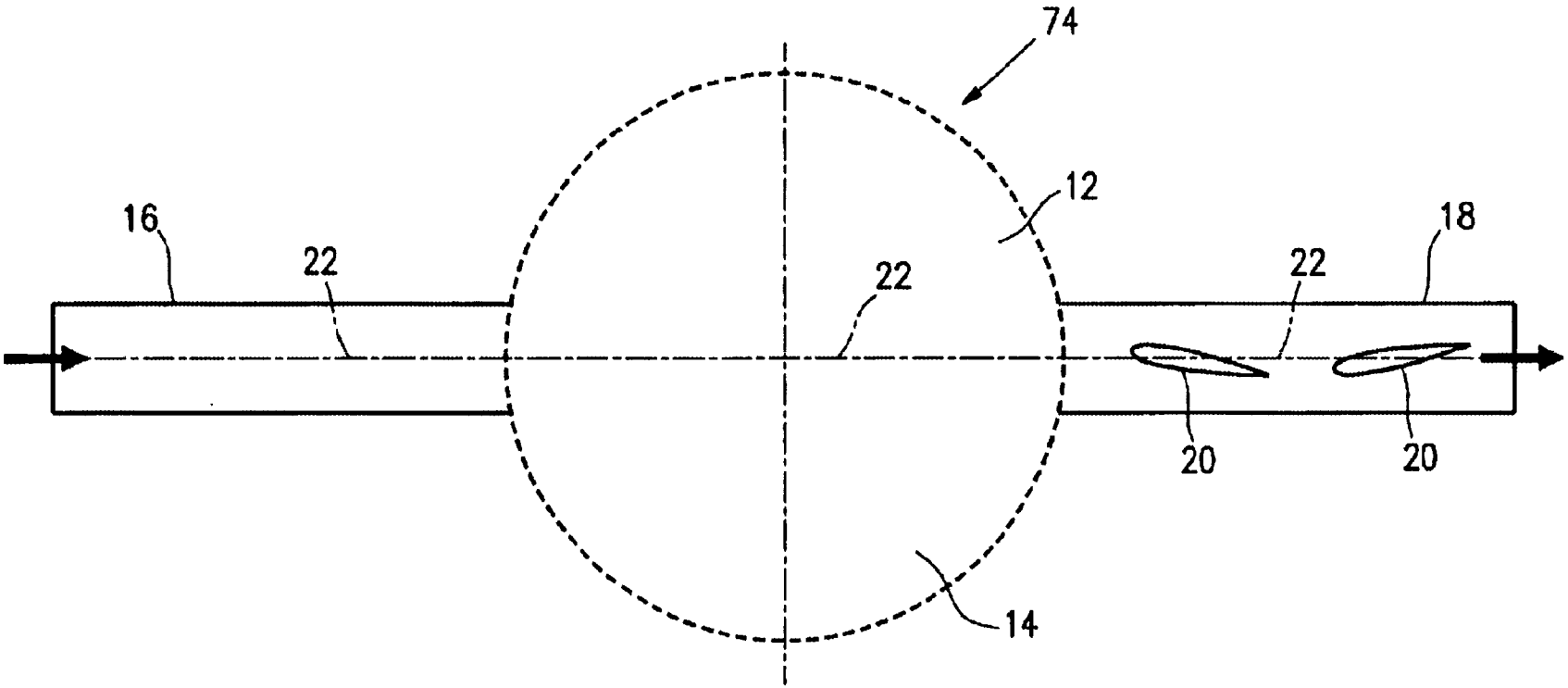
FIG. 5B is a top view of a still further embodiment of a micropump in accordance with the invention having multiple airfoil elements mounted only in the outlet channel thereof.

It is not necessary to mount the airfoil-shaped elements 20 in both the inlet channel 16 and the outlet channel 18. Alternative arrangements are shown in FIGS. 5A and 5B. In the embodiment of FIG. 5A, a valveless micropump 72 has two of the airfoil-shaped elements 20 mounted in the inlet channel 16 and no airfoil-shaped elements mounted in the outlet channel 18. Conversely, the embodiment of FIG. 5B shows a valveless micropump 74 in which two of the airfoil-shaped elements 20 are mounted in the outlet channel 18, with none in the inlet channel 16. Again, like or similar components in FIGS. 5A and 5B are identified by the same reference numerals as those used in the embodiment of FIGS. 1A and 1B.

The angle of attack of the airfoil-shaped elements 20 can be of any value as long as the airfoil produces a drag ratio larger than unity. It has been found, however, that an angle of attack between zero and 10 degrees provides superior results.

Figure 6A:
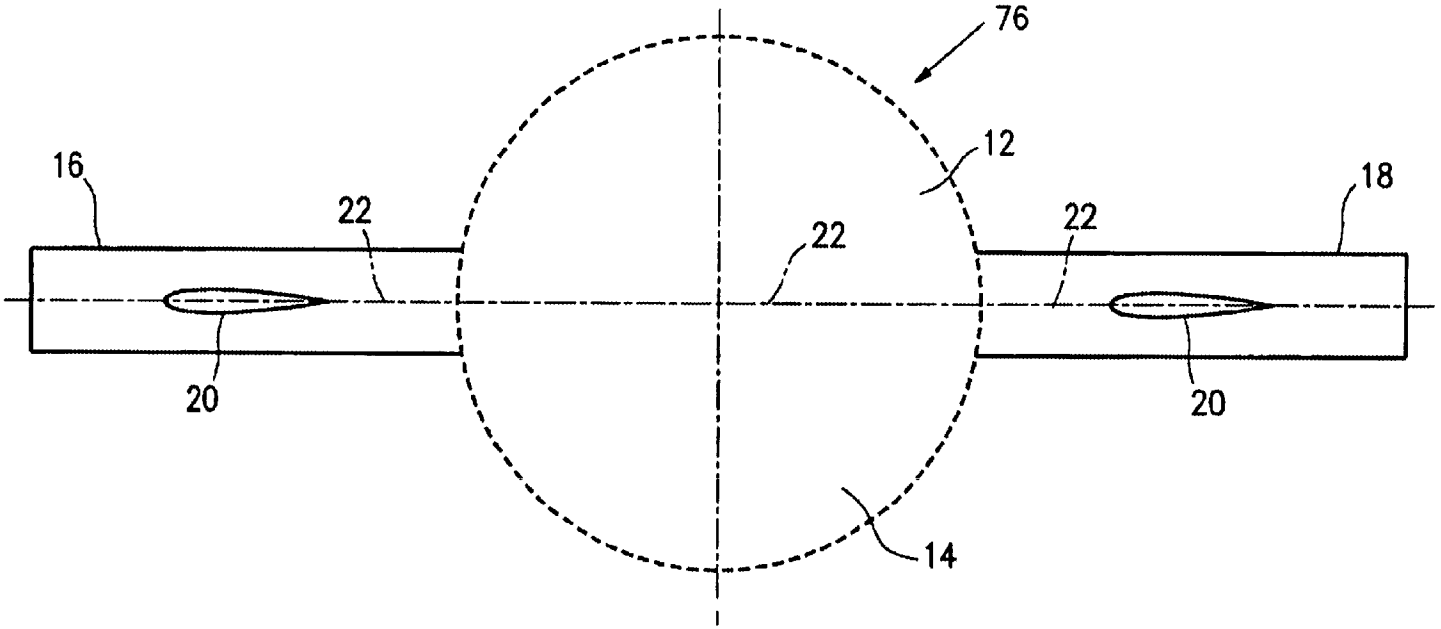
FIG. 6A is a top view of a still further embodiment of a micropump in accordance with the invention in which each of the inlet and outlet channels contains a single airflow element at an angle of attack of 0 degrees.
Figure 6B:
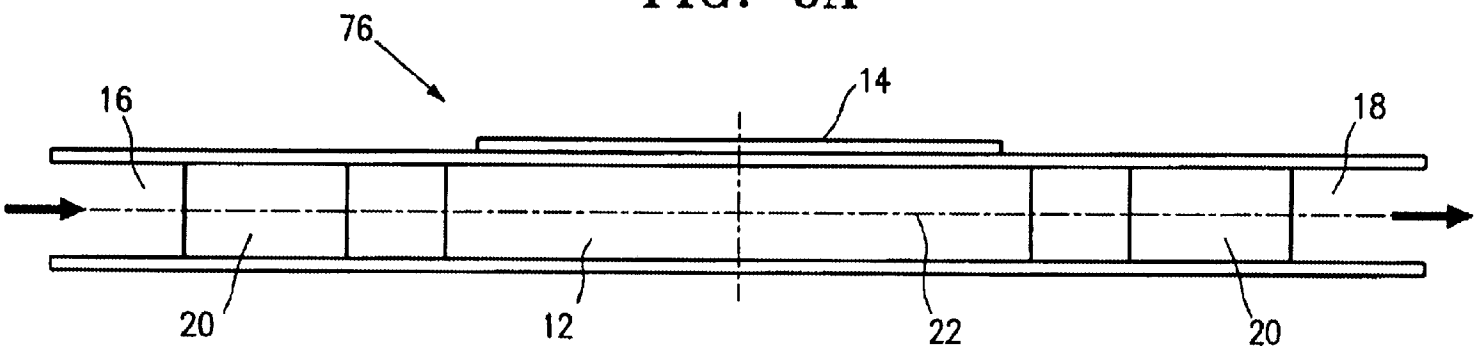
FIG. 6B is a front view of the micropump pump of FIG. 6A.

FIGS. 6A and 6B are top and front views, respectively, of a further embodiment of a valveless micropump 76, in which each of the inlet and outlet channels 16 and 18 contains a single one of the airfoil-shaped elements 20 mounted at an angle of attack of 0 degrees. This differs from the approximately 10 degrees angle of attack shown in the embodiment of FIGS. 1A and 1B, but still provides a reasonable flow-rate.

Figure 7A:
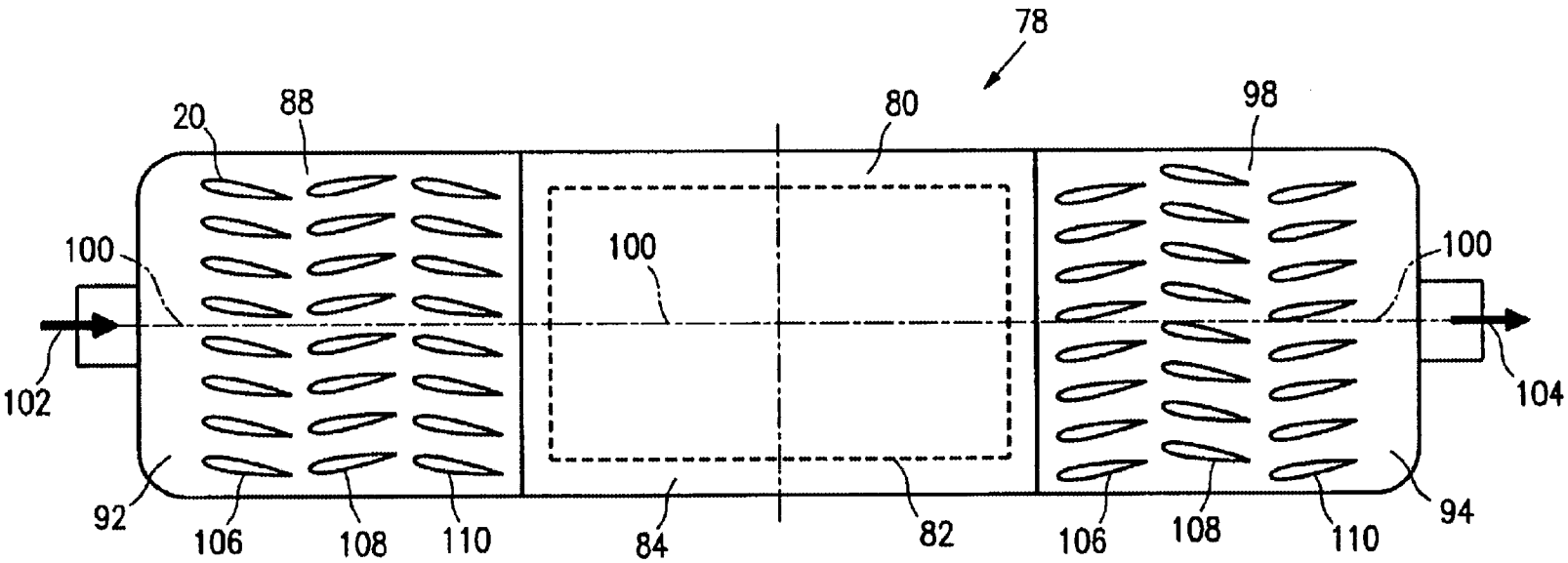
FIG. 7A is a top view of yet another embodiment of a micropump in accordance with the invention having multiple cascades of airfoil elements in each of the inlet and outlet channels.
Figure 7B:
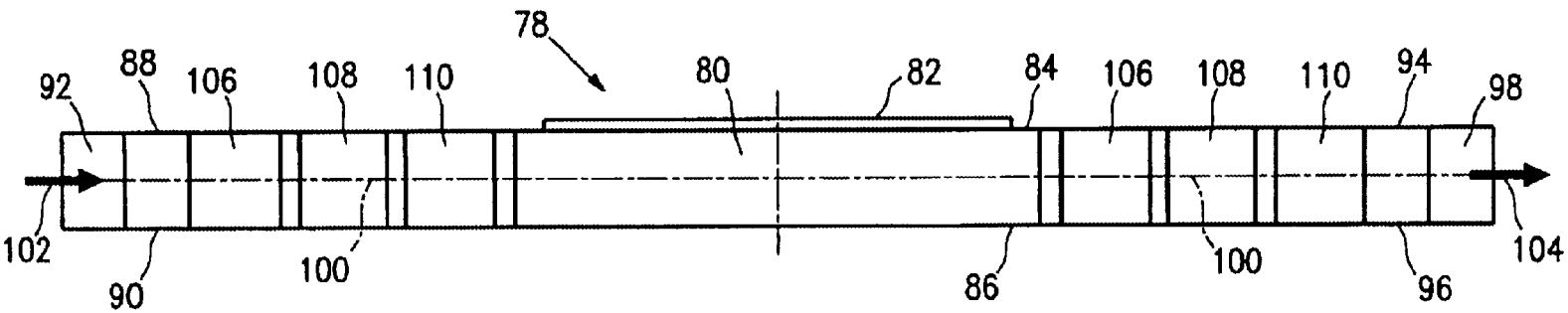
FIG. 7B is a front view of the micropump of FIG. 7A.

To increase the flow rate, cascades of airfoil elements 20 can be used. This is illustrated in FIGS. 7A and 7B, which are top and front views of yet another embodiment of a valveless micropump 78. Unlike the valveless micropumps of the prior embodiments, the micropump 78 of FIGS. 7A and 7B includes a micropump chamber 80 of generally rectangular configuration, with a rectangular electrostatic/piezoelectric membrane 82 mounted on a top 84 of the micropump chamber 80. The top 84 and an opposite bottom 86 of the micropump chamber 80 are of rectangular configuration and are generally continuous with an opposite top 88 and bottom 90 of an inlet channel 92, respectively, and an opposite top 94 and bottom 96 of an outlet channel 98. A central axis 100 extends through the inlet channel 92, the micropump chamber 80 and the outlet channel 98, and fluid flows in directions shown by arrows 102 and 104 at the inlet to the inlet channel 92 and the outlet of the outlet channel 98 respectively.

In the valveless micropump 78 of FIGS. 7A and 7B, each of the inlet and outlet channels 92 and 98 is provided with cascades of the airfoil-shaped elements 20 arranged in multiple rows or cascades 106, 108 and 110. The cascades 106, 108 and 110 of the airfoil-shaped elements 20 within each of the inlet and outlet channels 92 and 98 increase the directional efficiency of the valveless micropump 78.

Figure 8A:
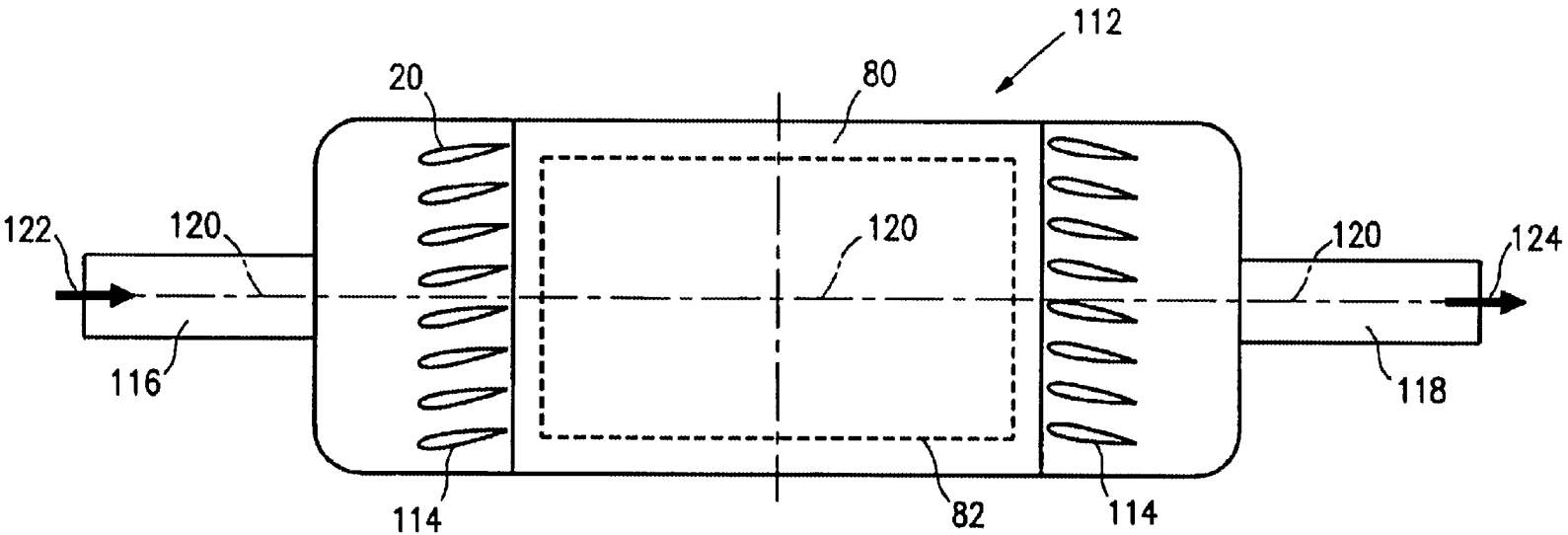
FIG. 8A is a top view of yet another embodiment of a micropump in accordance with the invention in which a single cascade of airfoil elements is located in each of the inlet and outlet channels.
Figure 8B:
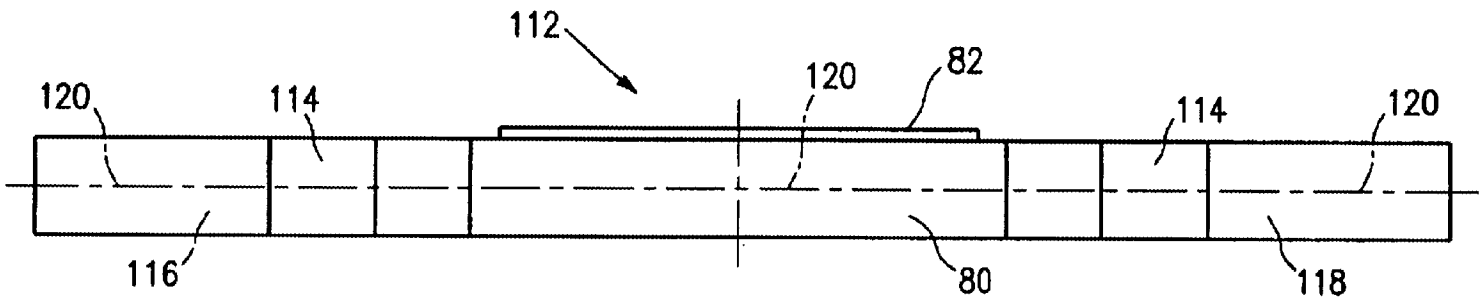
FIG. 8B is a front view of the micropump of FIG. 8A.

In valveless micropumps utilizing cascades of airfoil-shaped elements 20, such as the valveless micropump 78 of FIGS. 7A and 7B, there need not be any particular number of cascades. FIGS. 8A and 8B, for example, are top and front views of yet another embodiment of a valveless micropump 112 in which a single cascade 114 of the airfoil-shaped elements 20 is used in each of inlet and outlet channels 116 and 118. Like the valveless micropump 78 of FIGS. 7A and 7B, the micropump 112 of FIGS. 8A and 8B has a rectangular micropump chamber 80 and a rectangular electrostatic/piezoelectric membrane 82 in the manner of the embodiment of FIGS. 7A and 7B. The inlet and outlet channels 116 and 118 of FIGS. 8A and 8B are similar to the inlet and outlet channels 92 and 98 of the embodiment of FIGS. 7A and 7B, but are shorter in length. A central axis 120 extends through the inlet channel 116, the micropump chamber 80 and the outlet channel 118. Fluid flows in a direction illustrated by an arrow 122 at the inlet end of the inlet channel 116 and an arrow 124 at the outlet of the outlet channel 118.

The various embodiments of valveless micropumps in accordance with the invention are shown and described herein in terms of direction-sensitive drag-producing elements which are airfoil-shaped elements such as the elements 20. However, the invention is not limited to airfoils. The drag-producing elements can assume any appropriate shape as long as the resulting drag ratio is larger than unity.

What is claimed is:

1. A valveless micropump comprising:

a hollow pump chamber having a driving element coupled thereto;

an inlet channel coupled to the hollow pump chamber;

an outlet channel coupled to the hollow pump chamber;

the inlet channel, the hollow pump chamber and the outlet channel defining a fluid flow path through the inlet channel, the hollow pump chamber, and the outlet channel; and at least one direction-sensitive element disposed in the flow path within one of the inlet and outlet chambers;

wherein the flow path in which the direction-sensitive element is disposed has a substantially uniform width.

2. A valveless micropump comprising:

a hollow pump chamber having a driving element coupled thereto;

an inlet channel coupled to the hollow pump chamber;

an outlet channel coupled to the hollow pump chamber;

the inlet channel, the hollow pump chamber and the outlet channel defining a fluid flow path through the inlet channel, the hollow pump chamber, and the outlet channel; and at least one direction-sensitive element disposed in the flow path within one of the inlet and outlet chamber;

wherein the at least one direction-sensitive element comprises an airfoil.

3. A valveless micropump according to claim 2, wherein the airfoil is installed in the fluid flow path at an angle which produces a drag ratio greater than unity on fluid in the flow path.

4. A valveless pump comprising:

a pump chamber;

an electrostatic/piezoelectric member disposed at the pump chamber;

an inlet channel coupled to the pump chamber;

an outlet channel coupled to the pump chamber; and an airfoil element mounted in one of the inlet and outlet channels, the airfoil element producing a drag ratio greater than unity.

5. A valveless pump according to claim 4, wherein the pump is a micropump.

6. A valveless pump according to claim 4, wherein the airfoil element has an angle of attack of 0 degrees to 10 degrees.

7. A valveless pump according to claim 4, wherein the airfoil element has an angle of attack of approximately 0 degrees.

8. A valveless pump according to claim 4, wherein the airfoil element has an angle of attack of approximately 10 degrees.

9. A valveless pump according to claim 4, further comprising a second airfoil element mounted in the one of the inlet and outlet channels together with the first-mentioned airfoil element.

10. A valveless pump according to claim 6, wherein the first-mentioned airfoil element and the second airfoil element are both mounted in the inlet channel.

11. A valveless pump according to claim 6, wherein the first-mentioned airfoil element and the second airfoil element are both mounted in the outlet channel.

12. A valveless pump according to claim 4, wherein the first-mentioned airfoil element is mounted in the inlet channel, and further including a second airfoil element mounted in the outlet channel.

13. A valveless pump according to claim 4, comprising a first plurality of airfoil elements mounted in the inlet channel and a second plurality of airfoil elements mounted in the outlet channel.

14. A valveless pump according to claim 13, wherein each of the first and second pluralities of airfoil elements comprise a single cascade of such elements.

15. A valveless pump according to claim 13, wherein each of the first and second pluralities of airfoil elements comprise a plurality of cascades of such elements.

16. A valveless pump comprising:

a pump chamber of generally cylindrical configuration having opposite upper and lower walls of generally circular configuration and a sidewall of generally circular shape extending between the opposite upper and lower walls;

an electrostatic/piezoelectric membrane of generally circular configuration disposed on the upper wall opposite the lower wall;

an elongated inlet channel coupled to the side wall of the pump chamber at an opening therein and having opposite upper and lower walls which are joined to and generally coplanar with the upper and lower walls of the pump chamber;

an elongated outlet channel coupled to the side wall of the pump chamber at an opening therein opposite the opening therein at which the elongated input channel is coupled and having opposite upper and lower walls which are joined to and generally coplanar with the upper and lower walls of the pump chamber; and an airfoil element mounted in one of the inlet and outlet chambers and extending between the opposite upper and lower walls thereof.

17. A valveless pump according to claim 16, wherein the elongated inlet channel and the elongated outlet channel lie along a common axis of elongation extending through the pump chamber.

18. A valveless pump according to claim 17, wherein the airfoil element forms an angle of 0 degrees to 10 degrees with the common axis of elongation.

19. A valveless pump according to claim 18, wherein the airfoil element forms an angle of approximately 0 degrees with the common axis of elongation.

20. A valveless pump according to claim 18, wherein the airfoil element forms an angle of approximately 10 degrees with the common axis of elongation.

* * * * *